United States Patent [19]

McGrail et al.

[11] 4,093,458

[45] June 6, 1978

[54] POLYURETHANE-POLYANHYDRIDE SUBBING LAYER FOR PHOTO SENSITIVE ELEMENTS

[75] Inventors: Patrick Terence McGrail, Ipswich; Stephen Richard Smith, Manningtree; Frederick Robert Bannister, Colchester; David Leonard Boutle, Maldon, all of England

[73] Assignee: Imperial Chemical Industries Limited, London, England

[21] Appl. No.: 691,461

[22] Filed: Jun. 1, 1976

Related U.S. Application Data

[63] Continuation of Ser. No. 416,496, Nov. 16, 1973, abandoned.

[30] Foreign Application Priority Data

Nov. 20, 1972 United Kingdom ..... 53492/72
Jul. 13, 1973 United Kingdom ..... 33446/73

[51] Int. Cl.[2] ..... G03C 1/78

[52] U.S. Cl. ..... 96/87 R; 428/425; 428/483; 428/524; 427/171; 427/173; 427/209; 427/385 B; 427/407 G; 427/414

[58] Field of Search ..... 96/87 R; 117/138 B; 428/425, 483, 524; 427/171, 173, 209, 385 B, 407 G, 414

[56] References Cited

U.S. PATENT DOCUMENTS

| | | | |
|---|---|---|---|
| 3,454,424 | 7/1969 | Schneider | 96/87 R |
| 3,492,122 | 1/1970 | Takenaka et al. | 96/87 R |
| 3,649,438 | 3/1972 | Ross | 161/165 |
| 3,674,531 | 7/1972 | Shephard et al. | 96/87 R |
| 3,695,918 | 10/1972 | Ward | 428/349 |

*Primary Examiner*—Jack P. Brammer
*Attorney, Agent, or Firm*—Cushman, Darby & Cushman

[57] ABSTRACT

Polymeric subbing compositions for polyester photobase, especially polyethylene terephthalate films, comprising, a mixture of a polyurethane resin with a homopolymer or copolymer or a mixture of a homopolymer and a copolymer of an unsaturated cyclic carboxylic acid anhydride, preferably maleic anhydride or itaconic anhydride, in which the mixture contains up to 75% by weight of the anhydride polymer.

9 Claims, No Drawings

POLYURETHANE-POLYANHYDRIDE SUBBING LAYER FOR PHOTO SENSITIVE ELEMENTS

This is a continuation, of application Ser. No. 416,496 filed Nov. 16, 1973 now abandoned.

This invention relates to synthetic film materials formed from coated oriented polyester films and to base materials of use in the production of photographic materials.

Polyester films, such as polyethylene terephthalate films are extremely hydrophobic and it is necessary to take certain measures to ensure that the adhesion between the film surface and the hydrophilic light sensitive emulsion layer, such as a gelatino silver halide emulsion layer, applied thereto is maintained throughout the processing treatment to which they may be subjected. Generally one or more intermediate anchoring layers, which are often termed "subbing" or "substratum" layers, are employed. For instance a polymeric layer may be applied directly to the film surface followed by a gelatin containing layer to progressively build up adhesion to the finally applied light sensitive layer.

Generally the polymeric subbing layer may be applied to the polyester film surface either during the production of the film, e.g. after the film has been stretched in one direction as part of the orientation process and before it is stretched in the second direction, or after the production of the film has been completed. In the case where coating is effected after the production of the film has been completed it is usual to employ the coating process entirely independently of the process for film production. The present invention is concerned with photographic film base materials which are produced by such processes.

British patent specification No. 1,088,906 is concerned with polymeric subbing layers containing homopolymers or copolymers of a vinyl halogenoester or a vinyl cyanoester and in particular copolymers of vinyl monochloracetate with vinyl acetate and/or vinyl alcohol. For general photographic uses such polymeric subbing layers produce adequate adhesion but it has been found that the adhesion may not be strong enough in certain specialised end uses in which the adhesion of the subbing layers must withstand extreme treatment. For instance extreme conditions of use arise in the graphic arts field in which lith films are occasionally treated with organic solvents such as methylated spirit in order to remove masking lacquers. Organic solvents which are compatible with water are also sometimes used to accelerate the final drying of photographic films. The resistance of assemblies such as those disclosed in British patent specification No. 1,088,906 is often weak when subjected to treatment with such solvents and if the removal of masking lacquers involves vigorous rubbing the adhesion of the silver halide emulsion layer to the underlying layers is likely to fail. Typical processing equipment for graphic arts lith film often employs edge grips for transporting the wet film through the equipment and these grips subject the film to a severe rubbing action which can destroy the adhesion of the silver halide emulsion layer to the assembly. Graphic arts films are also required to lie flat. High temperatures are often used to dry the applied subbing layers, for instance temperatures of the order of 100° to 120° C are employed in British patent specification No. 1,088,906, and these temperatures tend to impair the flatness characteristics of the polyester film support.

Developing solutions employed for processing silver halide emulsion films commonly have a pH in the region of 10.5 but the value can be as high as 12.8 and such high pH values impair the adhesion of the silver halide emulsion to the substrates shown in Britich patent specification No. 1,088,906.

In the graphic arts field there is a trend towards the use of thinner silver halide emulsions to facilitate more rapid processing and consequently these must be harder since they must resist failure during rapid automatic processing. The resistance of the assemblies disclosed in British patent specification No. 1,088,906 to solvent treatments which are employed to remove masking lacquers and to edge gripping on automatic processing equipment is weaker when very hard silver halide emulsions are used.

It has now been found that adequate adhesion can be obtained when a substratum layer comprising a polyurethane resin admixed with another polymer containing carboxylic acid anhydride groups is employed.

According to the present invention a photographic film base material comprises a biaxially oriented film support of a linear polyester and a subbing layer applied to one or both surfaces thereof, the subbing layer comprising a mixture of one or more polyurethane resins with (a) one or more homopolymer(s) of polymerisable unsaturated cyclic carboxylic acid anhydrides, (b) one or more copolymer(s) of polymerisable unsaturated cyclic carboxylic acid anhydrides with one or more other copolymerisable monomers or (c) one or more such homopolymer(s) and one or more such copolymer(s), the mixture containing up to 75% by weight of the anhydride homopolymer(s) and/or copolymer(s).

The invention also relates to a process for producing such a photographic film base material in which the biaxially oriented linear polyester film support is coated on one or both sides with a subbing layer of a mixture as hereinbefore specified, is then coated on one or both sides with a gelatin-containing layer and is then heated to a temperature of up to 110° C.

The polyester film support may consist of any suitable linear polyester, such polyesters being produced by condensing one or more dicarboxylic acids or their lower alkyl diesters e.g. terephthalic acid, isophthalic, phthalic, 2,5-, 2,6- or 2,7-naphthalene dicarboxylic acid, succinic acid, sebacic acid, adipic acid, azelaic acid, bibenzoic acid, and hexahydroterephthalic acid, or bis-p-carboxyphenoxy ethane, with one or more glycols, e.g. ethylene glycol, 1,3-propanediol, 1,4-butanediol, neopentyl glycol and 1,4-cyclohexanedimethanol. It is to be understood that the polyester film support may consist of a copolyester of any of the above materials. The preferred polyester film support is polyethylene terephthalate film. Polyethylene terephthalate films may be biaxially oriented by stretching and dimensionally stabilised (by heat setting) by any of the processes known in the art, for instance according to British patent specification No. 838,708. Some commercially available grades of biaxially oriented polyethylene terephthalate film have a polymeric layer, such as a vinylidene chloride copolymer layer, already applied to one or both surfaces. Such coated films may be employed as the film support in this invention although it is preferred that the subbing layer be applied to a film support which has not been pretreated with such a polymeric layer.

The preferred film supports may however be subjected to a pretreatment in order to promote adhesion before the subbing mixture of this invention is applied. Preferably the pretreatment involves coating the film surface with a thin polymer coating or with a material having a swelling or solvent action upon the film, e.g. a solution in a common organic solvent such as acetone or methanol of p-chloro-m-cresol, 2,4-dichlorophenol, 2,4,6- or 2,4,5-trichlorophenol or 4-chlororesorcinol or a mixture of such materials in a common organic solvent. After such a solution has been applied to the film surface it is dried at an elevated temperature for a few minutes before applying the subbing mixture.

The anhydride containing polymer of the subbing mixture may be a homopolymer of a polymerisable cyclic carboxylic acid anhydride but preferably comprises a copolymer of an unsaturated cyclic carboxylic acid anhydride with any other suitable copolymerisable monomer or a mixture of monomers.

The unsaturated cyclic carboxylic acid anhydride may be chosen from suitable polymerisable unsaturated dicarboxylic acid anhydrides, such as maleic anhydride, a chloromaleic anhydride or any other substituted maleic anhydride, or itaconic anhydride or citraconic anhydride. The preferred anhydrides for the production of the polymers employed in this invention are maleic anhydride and itaconic anhydride.

The other copolymerisable monomer or monomers which may be used may consist of any suitable known material such as styrene, vinyl acetate, ethylene, methyl methacrylate, butadiene, methyl vinyl ether or a vinyl halogenoester such as vinyl monochloracetate. Preferably the anhydride containing polymer is a copolymer of maleic anhydride or itaconic anhydride with styrene, vinyl acetate or butadiene. Approximately equimolar proportions of the anhydride and comonomer may be used.

Anhydride containing copolymers may contain up to 60 mole % of the anhydride component. Thus copolymers of 50 mole % of an anhydride formed with 50 mole % of any one of the comonomers mentioned above have been found to operate satisfactorily as subbing layers. Amounts of the anhydride in the copolymer down to about 3 mole % are also acceptable. Thus a terpolymer of 60/34/6 mole % vinyl monochloracetate/methyl methacrylate/maleic anhydride respectively has been found to operate satisfactorily.

The anhydride containing polymers may be prepared by any of the known free radical processes of solution polymerisation in solvents such as ethyl acetate, methyl ethyl ketone, dioxane or acetone, and may be isolated by precipitation in a suitable non-solvent for the polymer. The molecular weight may be in the range 400 to 500000. The isolated polymer may be incorporated into the coating composition from which the subbing admixture is applied by dissolving it together with the polyurethane resin in a suitable organic solvent medium which may include a ketone such as acetone or methyl ethyl ketone, esters such as ethyl acetate or chlorinated hydrocarbons such as methylene chloride. Alternatively the anhydride containing copolymer need not be isolated and may be employed for subbing directly from the reaction solution in which it is prepared suitably diluted with a volatile organic solvent.

The subbing mixture applied to the film support preferably contains up to 60% by weight of the anhydride containing polymer. When the anhydride copolymer is formed from 50% by weight of the anhydride monomer with one or more comonomers, the subbing mixture may conveniently contain from 10 to 20% by weight of the anhydride polymer, based on the total polymeric content of the subbing mixture. When an anhydride terpolymer, such as a 60/34/6 mole % vinyl monochloroacetate/methyl methacrylate/maleic anhydride is used, the amount of copolymer used may be somewhat higher, e.g. in the range 30 to 50% by weight, based on the total polymeric content of the subbing mixture. The components of the subbing mixture are therefore present in these proportions upon the final coated and dried photographic film base material.

The polyurethane resin incorporated into the subbing mixture may comprise one or more linear, substantially unreactive, organic media soluble, synthetic block copolymers formed by the condensation of a hydroxy-terminated polyester, polyether, polyesteramide or other suitable material known in the art, or a mixture of two or more of these, or a mixture of one or more of these with a chain extender, the latter being a low molecular weight difunctional alcohol, difunctional amine, amino-alcohol or a mixture of two or more of these materials, with one or more di-isocyanate. The polyurethane resins formed by this method, or other methods known in the art, consist of block polymers linked together by predominently urethane groups but also contain a number of other groups such as urea, amino and allophanate.

When the polyurethane is formed from a hydroxy-terminated polyester it is preferred that the hydroxy-terminated polyester should be linear, with a very low acid number, very low water content and having a molecular weight in the range of 200–5000. Such hydroxy-terminated polyesters may be formed by any of the well known methods, for example, the esterification of one or more glycols such as ethylene glycol, propylene glycol, 1,3-butane diol, 1,4-butane diol, diethylene glycol or a polyether polylol with one or more carboxylic acids, carboxylic acid chlorides or carboxylic acid anhydrides such as adipic acid, sebacic acid, terephthalic acid, isophthalic acid or phthalic anhydride. The hydroxy-terminated polyesters may also be formed by the polymerisation of cyclic monomers such as $\epsilon$-caprolactone. Preferably the polyester is polyethylene adipate, polytetramethylene adipate, an ethylene/tetramethylene adipate copolyester, an ethylene glycol/diethylene glycol adipate copolyester or a polycaprolactone polyol.

If a polyurethane formed from polyether polyols is employed, the preferred polyether polyols have a molecular weight in the region of 200–5000. They may be formed from the homopolymerisation or copolymerisation of materials such as ethylene oxide, propylene oxide and tetrahydrofuran. The preferred polyether polyol is poly(oxytetramethylene)glycol.

Polyurethanes formed from hydroxy-terminated polyesteramides are preferably formed from saturated and linear, polyesteramides having very low acid numbers and water contents and a molecular weight in the range of 200–5000. They may be formed by any of the well known methods such as the reaction of a difunctional carboxylic acid or carboxylic acid anhydride or a mixture of the two, with one or more amino-alcohols, with a mixture of one or more amino-alcohols with one or more diols or diamines or with a mixture of one or more diols with one or more diamines. Reactions for the production of suitable polyesteramides may be effected between carboxylic acids or carboxylic acid anhydrides such as adipic acid, sebacic acid, terephthalic acid, isophalic acid and phthalic anhydride and amino-alcohols such as ethanolamine optionally in admixture with diols or diamines such as ethylene glycol, diethylene glycol or ethylene diamine. The preferred polyesteramide is prepared from adipic acid with a mixture of ethylene glycol, diethylene glycol and ethanolamine.

If a chain extender is employed it may be any low molecular weight aromatic or aliphatic difunctional alcohol, difunctional amine, amino-alcohol or a mixture of two or more of these materials. It may optionally contain traces of trifunctional alcohols or amines. Preferably the chain extender (when employed) is chosen from 1,3-butane diol, 1,4-butane diol, ethylene glycol, diethylene glycol, ethanolamine, ethylene diamine, or a mixture of two or more of these materials.

Small quantities of water may be deliberately added to the polyurethane-forming reactants to introduce urea linkages and some degree of branching.

When a di-isocyanate is used it may be any difunctional aromatic or aliphatic isocyanate or a mixture of any two or more of these materials, but preferably is an isomer or mixture of isomers of tolylene di-isocyanate, or is diphenyl methane 4,4'-di-isocyanate, 1,5-naphthalene di-isocyanate or hexamethylene di-isocyanate.

The preferred polyurethane resins have a molecular weight in the range 1000 to 250000 and are those formed (1) by the condensation of one mole of polyethylene adipate with one mole of a 65/35% by weight mixture of 2,4-tolylene di-isocyanate with 2,6-tolylene di-isocyanate, (2) from the condensation of one mole of polytetramethylene adipate and one mole of 1,4-butane diol with two moles of diphenyl methane 4,4'-di-isocyanate, (3) by the reaction of one mole of a polyesteramide, prepared from adipic acid, diethylene glycol, ethylene glycol and ethanolamine, and 0.2 moles of ethylene glycol with 1.2 moles of an 80/20% by weight mixture of 2,4-tolylene di-isocyanate with 2,6-tolylene di-isocyanate and (4) by the condensation of one mole of polyethylene adipate of molecular weight 2000 and one mole of 1,4-butane diol with two moles of an 80/20% by weight mixture of 2,4-tolylene di-isocyanate and 2,6-tolylene di-isocyanate.

The polyurethanes may be prepared by any suitable known solution polycondensation method in a solvent such as ethyl acetate, dimethyl formamide or methyl ethyl ketone, and as with the anhydride containing copolymer, may be isolated by precipitation in a suitable non-solvent for the polyurethane, or may be used directly from the reaction solution without isolation, diluted with a suitable volatile organic solvent. Alternatively, the polyurethanes may be prepared by any suitable known melt-condensation method of polymerisation and may be rendered soluble, if necessary, by milling on a rubber mill before being dissolved in a suitable volatile organic solvent such as acetone, methyl ethyl ketone, ethyl acetate or chlorinated hydrocarbons such as methylene chloride from which it may be applied to the film support in admixture with the anhydride copolymer.

Polyurethane resins and mixtures of polyurethane resins with anhydride-containing copolymers are readily cross-linked and suitable cross-linking substances for inclusion in the subbing composition are multifunctional compounds which are known to react with carboxylic acid, carboxylic acid anhydride or urethane groups. Compounds such as diethanolamine, polyethylene glycol, hexamethoxy methyl melamine and melamine-formaldehyde resins have been found to be suitable, the preferred cross-linking agent to use being hexamethoxy methyl melamine.

The subbing layer comprising the mixture of polyurethane resin and anhydride copolymer may be applied to the surface of the film support, which has preferably been pretreated as specified above to promote adhesion, by any of the known coating techniques, e.g. by dip coating, bead coating, reverse roller coating or slot coating which are suitable for the coating of the admixture from an organic solvent solution. The applied coating may be dried at temperatures of from 70° to 90° C for up to 10 minutes, drying at about 80° C for about 2 minutes generally being useful. The final dry coat weight of the applied subbing layer is preferably within the range 0.1 to 10 mg/dm$^2$.

A cross-linking agent may optionally be included in the subbing composition since cross-linking develops the optimum properties in the subbing layer.

A gelatin subbing layer may be applied over the polyurethane-anhydride copolymer admixture subbing layer by any of the known processes for coating from an organic solvent to give a final dry coat weight which would typically be of the order of 0.1 to 3 mg/dm$^2$. The gelatin layer may contain materials such as polyvinyl acetate or particulate materials such as silica to lower the surface friction and act as an anti-blocking agent and in addition may contain one of the well known cross-linking agents for gelatin such as formalin. In the course of completion of the final photographic film element an anti-static agent may be applied, coated on top of the gelatin subbing layer.

The coated film support is usually dried after the application of each treating or coating composition, e.g. after the film has been pretreated with a thin polymeric coating or solvent or swelling agent, after it has been coated with the polyurethane/anhydride polymer subbing composition, and after it has been coated with the gelatin-containing layer. The coated base material is also heated after drying the gelatin-containing layer, to develop the desired adhesion and other properties.

The drying operations are effected to remove the solvent from each layer although a small residue of solvent may remain, and the temperature employed is not critical as far as solvent removal alone is concerned but should be high enough to drive off the solvent, although higher temperatures may affect the flatness of the film support. The temperature used is generally lower than that used in the adhesion developing stage. Thus the polyurethane resin-anhydride polymer subbing layer may be dried at temperatures of from 70° to 90° C, as specified above and the gelatin subbing layer may be dried at temperatures in the range 60° to 80° C, drying being continued for one to two minutes. The gelatin-containing layer may conveniently be dried as it is transported towards the heat treatment station, e.g. when the heat treatment is effected in a hot air oven drying may be accomplished in a hot air region of the oven preceding the heat treatment station.

After the gelatin-containing layer has been dried the whole assembly is then subjected to the heating treatment which develops adhesion and also serves to remove any remaining traces of solvent and promote chemical reaction within the coatings, such as cross-linking, whenever such reactions may be involved. This heating treatment may be effected at temperatures of up to 110° C for several minutes. Temperatures in the region of 95° C have been found to provide satisfactory results.

Conventional light sensitive emulsion layers, e.g. a gelatino silver halide emulsion, may be applied over the gelatin layer by known techniques.

The photographic assemblies having subbing layers according to this invention are suitable for uses in which the assembly will encounter extreme conditions of usage and treatment. The film also has acceptable flatness. The photographic film base materials of this invention are suitable for most photographic end uses and in particular for use in the graphic arts field.

The present invention is further illustrated by the following Examples. In all of the Examples 1 to 9 and Examples 11, 12 and 13 the film support employed was a conventionally biaxially oriented and heat set polyethylene terephthalate photo base film of thickness 0.004 inch.

EXAMPLE 1

The film support was pretreated on both sides with a solution made up of 2 g of p-chloro-m-cresol dissolved in 100 ml of methanol, to give a wet coat weight of 100 mg/dm$^2$ and then dried for 2 minutes at 60°–80° C to give a residual coat weight of between 0.1 and 0.5 mg/dm$^2$. The pretreated film was then coated on both sides with the following subbing solution:

| Ingredient | Quantity |
|---|---|
| Condensation polymer prepared from a 1/1/2 mole ratio of polyethylene adipate (molecular weight 1000)/ 1,4-butane diol/tolylene di-isocyanate (80/20% by weight of 2,4- and 2,6-isomers) | 0.5 g |
| Copolymer prepared from 60 mole % vinyl monochloracetate with 34 mole % methyl methacrylate and 6 mole % maleic anhydride, by solution polymerisation in acetone | 0.5 g |
| Hexamethoxy methyl melamine | 0.03 g |
| p-Toluene sulphonic acid | 0.01 g |
| Acetone | 97.0 ml |
| Cyclohexanone | 3.0 ml |

After drying for 2 minutes at 80° C this coating had a final dry weight of between 1 and 2 mg/dm$^2$ on each side of the film. The coated surfaces of the film were then subbed with a gelatin subbing solution of the following composition:

| Ingredient | Quantity |
|---|---|
| Gelatin | 1.2 g |
| Water | 5.0 ml |
| Glacial acetic acid | 1.0 ml |
| Methanol | 94.0 ml |
| Polyvinyl acetate (available commercially under the Trade Name "Mowilith" 70) | 0.125 g |
| Formalin | 0.05 ml |
| Benzyl alcohol | 2.0 ml |

After drying for 2 minutes at 80° C this gelatin coating had a dry coat weight of approximately 2 mg/dm$^2$ on each side of the film. The assembly was then heated for 3 minutes at 105° C.

Finally the gelatin subbed film was coated on one side with a conventional photographic gelatino silver halide lith emulsion and on the other side with a conventional anti-halo backing. The film was chilled to gel the coatings and dried for 20 minutes at 40° C.

The photographic film thus obtained had excellent adhesion before, during and after processing including developing in highly alkaline developers, showed good resistance to treatment with methylated spirit, was resistant to crazing after heating for 1 hour at 80° C and had good wet edge rub resistance. There was no deterioration in any of the aforementioned properties when the film was incubated before testing for 7 days at 50° C and 67% relative humidity to simulate accelerated ageing. No adverse sensitometric or coat quality defects on the photographic emulsion were observed. Some of the properties of the assembly are shown in the Table given after Example 13.

EXAMPLE 2

The film support was pretreated and coated on both sides with a subbing solution as described in Example 1. After drying for 2 minutes at 80° C this coating had a final dry weight of between 1 and 2 mg/dm$^2$. The coated surfaces were then subbed with a gelatin subbing solution as in Example 1 and dried for 1 minute at 80° C before being heated for 3 minutes at 85° C. A photographic gelatino silver halide lith emulsion and a conventional anti-halo backing were coated onto the gelatin subbing layers as in Example 1. The photographic film assembly thus obtained had the excellent adhesion properties of Example 1 and in addition the film was flat lying with very little fluting at the edges or centre. Some of the properties of the assembly are shown in the Table which is given after Example 13.

EXAMPLE 3

The film support was pretreated on both sides with a solution made up of 2 g of p-chloro-m-cresol dissolved in 100 ml of methanol, to give a wet coat weight of 100 mg/dm$^2$ of the solution, and then dried for 2 minutes at 60°–80° C to give a residual coat weight of between 0.1 and 0.5 mg/dm$^2$. The pretreated film was then coated on both sides with the following subbing solution:

| Ingredient | Quantity |
|---|---|
| Condensation polymer (inherent viscosity of a 0.2 g/dl solution in acetone at 25° C being 0.58) prepared from a 1/1/2 mole ratio of polyethylene adipate (molecular weight 2000)/1,4-butane diol/ tolylene di-isocyanate (80/20% by weight mixture of 2,4- and 2,6-isomers) | 0.8 g |
| Copolymer prepared from a 50/50 mole % mixture of vinyl acetate/maleic anhydride (inherent viscosity of a 0.2 g/dl solution in acetone at 25° C being 0.3) by solution polymerisation in a mixture of 5 parts by volume of ethyl acetate and 1 part by volume of acetone | 0.16 g |
| Hexamethoxymethyl melamine (available commercially under the Trade Name "Cymel" 300) | 0.03 g |
| p-Toluene sulphonic acid | 0.01 g |
| Acetone | 97.0 ml |
| Cyclohexanone | 3.0 ml |

After drying for 2 minutes at 80° C this coating had a final dry coat weight of between 1 and 2 mg/dm$^2$ on each side of the film. The coated surfaces of the film were then subbed with a gelatin subbing solution of the following composition:

| Ingredient | Quantity |
|---|---|
| Gelatin | 1.2 g |
| Water | 5.0 ml |
| Glacial acetic acid | 1.0 ml |
| Methanol | 94.0 ml |
| Formalin | 0.05 ml |
| Polyvinyl acetate (available commercially under the Trade Name | |

-continued

| Ingredient | Quantity |
|---|---|
| "Mowilith" 70) | 0.05 g |

The gelatin coating was dried for 1 minute at 80° C and then the assembly was heated for 3 minutes at 105° C. The gelatin coating had a dry coat weight of approximately 2 mg/dm$^2$ on each side of the film. Finally the gelatin subbed film was coated on one side with a conventional photographic gelatino silver halide lith emulsion and on the other side with a conventional anti-halo backing. The film was chilled to gel the coatings and dried for 20 minutes at 40° C.

The photographic film assembly thus obtained had excellent emulsion adhesion before, during and after processing including developing in highly alkaline developers, showed good resistance to treatment with methylated spirit, was resistant to crazing after heating for 1 hour at 80° C and had good wet edge rub resistance. No adverse sensitometric or coating quality defects on the photographic emulsion were observed.

EXAMPLE 4

The film support was pretreated as in Example 3 and was coated on both sides with the following subbing solution:

| Ingredient | Quantity |
|---|---|
| Condensation polymer prepared from a 1/1/2 mole ratio of polyethylene adipate/1,4-butane diol/tolylene di-isocyanate (80/20% by weight mixture of 2,4- and 2,6-isomers in ethyl acetate solution | 0.66 g |
| Copolymer of butadiene/maleic anhydride (commercially available under the Trade Name "Maldene" 285) | 0.34 g |
| Hexamethoxymethyl melamine | 0.007 g |
| p-Toluene sulphonic acid | 0.007 g |
| Acetone | 97.0 ml |
| Cyclohexanone | 3.0 ml |

After drying for 2 minutes at 80° C this coating had a final dry weight of between 1 and 2 mg/dm$^2$. The coated surfaces were then subbed with a gelatin subbing solution as in Example 3, dried for 1 minute at 80° C and then heated for 3 minutes at 85° C. Conventional photographic gelatino silver halide lith emulsion and anti-halo backing coatings were coated onto the gelatin sub layers as in Example 3. The photographic assembly thus obtained had the excellent properties of Example 2.

EXAMPLE 5

The film support was pretreated as in Example 3 and was coated on both sides with the following subbing solution:

| Ingredient | Quantity |
|---|---|
| The material which is commercially available under the Trade Name "Daltoflex" 445M (condensation polymer of polyesteramide/ethylene glycol/tolylene di-isocyanate prepared in methyl ethyl ketone solution | 0.8 g |
| Copolymer prepared from a 50/50 mole % mixture of styrene/maleic anhydride by solution polymerisation in acetone. | 0.16 g |
| Hexamethoxy methyl melamine | 0.007 g |
| p-Toluene sulphonic acid | 0.007 g |
| Acetone | 97.0 ml |

-continued

| Ingredient | Quantity |
|---|---|
| Cyclohexanone | 3.0 ml |

After drying for 2 minutes at 80° C this coating had a final dry weight of between 1 and 2 mg/dm$^2$. The coated surfaces were then subbed with a gelatin subbing solution and dried for 1 minute at 80° C as in Example 3 and heated for 3 minutes at 85° C. A solution prepared from 0.2 g of potassium ethyl phosphate in a 90/10% by volume stock solution of methanol and water was applied to one side of the film and dried for 2 minutes at 80° C to give a dry coat weight of between 0.1 and 0.2 mg/dm$^2$ and a surface resistivity of approximately $10^{10}$ ohms per sq.

Finally a photographic gelatino silver halide X-ray emulsion was coated onto both sides of the film, chilled to gel the emulsion and dried for 20 minutes at 40° C.

The photographic assembly thus obtained had excellent adhesion before, during and after processing and no adverse sensitometric or coat quality effects on the X-ray emulsion were observed.

EXAMPLE 6

The film support was pretreated by coating both sides with a solution of:

| Ingredient | Quantity |
|---|---|
| The material which is commercially available under the Trade Name "Vitel" PE200 (polyethylene isophthalate/terephthalate copolymer) | 1.0 g |
| Tetra isopropyl titanate | 0.05 g |
| Methylene chloride | 100 ml |

After drying for 2 minutes at 80° C this coating had a final dry weight of between 1 and 2 mg/dm$^2$ on each side of the film.

The pretreated film was then coated on both sides with the following subbing solution:

| Ingredient | Quantity |
|---|---|
| The material which is available commercially under the Trade Name "Desmocoll" 176 (condensation polymer of polyethylene adipate/tolylene di-isocyanate) | 0.8 g |
| Copolymer prepared from a 50/50 mole ratio of vinyl acetate/maleic anhydride | 0.1 g |
| Hexamethoxy methyl melamine | 0.007 g |
| p-Toluene sulphonic acid | 0.007 g |
| Acetone | 97.0 ml |
| Cyclohexanone | 3.0 ml |

After drying for 2 minutes at 80° C the coated film surfaces were subbed with a gelatin sub layer, dried for 1 minute at 80° C and then heated for 3 minutes at 85° C and coated with a conventional gelatino silver halide lith emulsion and conventional anti-halo backing as described in Example 2.

The photographic film assembly thus obtained had the same excellent properties as the assembly described in Example 2.

EXAMPLE 7

The film support was pretreated by coating both sides with a solution prepared from 1.0 g of a 20/80% by weight mixture of resorcinol and p-chlororesorcinol in 100 ml of methanol to give a wet coat weight of approximately 100 mg/dm² and then dried for 2 minutes at 80° C. The pretreated support was then coated on both sides with the following solution:

| Ingredient | Quantity |
|---|---|
| The material which is available commercially under the Trade Name "Estane" 5713F (condensation polymer of polytetramethylene adipate/ 1,4-butane diol/diphenyl methane 4,4'-di-isocyanate) | 0.8 g |
| Copolymer prepared from a 50/50 mole % mixture of vinyl monochloracetate/ maleic anhydride | 0.16 g |
| Hexamethoxy methyl melamine | 0.007 g |
| p-Toluene sulphonic acid | 0.007 g |
| Acetone | 97.0 ml |
| Cyclohexanone | 3.0 ml |

After drying for 2 minutes at 80° C the coated film was subbed on both sides with a gelatin sub layer, dried for 1 minute at 80° C before being heated for 3 minutes at 85° C and coated with a gelatino silver halide lith emulsion on one side and anti-halo backing on the other side as described in Example 2.

The photographic film assembly thus obtained had the same properties as the assembly produced in Example 2.

EXAMPLE 8

The film support was pretreated as in Example 3 and was coated on both sides with the following subbing solution:

| Ingredient | Quantity |
|---|---|
| The material which is available commercially under the Trade Name "Elastostik"- 2005T (condensation polymer of polyethylene adipate/ tolylene di-isocyanate) | 0.80 g |
| Copolymer prepared from a 50/50 mole % mixture of vinyl acetate/ itaconic anhydride | 0.16 g |
| Hexamethoxy methyl melamine | 0.007 g |
| p-Toluene sulphonic acid | 0.007 g |
| Acetone | 97.0 ml |
| Cyclohexanone | 3.0 ml |

After drying for 2 minutes at 80° C the film was subbed on both sides with a gelatin sub layer which was dried for 1 minute at 80° C and the assembly heated for 3 minutes at 105° C and coated with a gelatino silver halide lith emulsion on one side and anti-halo backing on the other side as described in Example 3.

The photographic film assembly thus obtained had the same properties as the film produced in Example 3.

EXAMPLE 9

The film support was pretreated as in Example 3 and was coated on both sides with the following solution:

| Ingredient | Quantity |
|---|---|
| Condensation polymer prepared from a 4/1/5 mole ratio of polyethylene adipate/1,4-butane diol/tolylene di-isocyanate (80/20% by weight mixture of 2,4- and 2,6-isomer) | 0.9 g |
| Copolymer of butadiene/maleic anhydride (available commercially under the Trade Name "Maldene" 285) | 0.1 g |
| Hexamethoxy methyl melamine | 0.007 g |
| p-Toluene sulphonic acid | 0.007 g |
| Acetone | 97.0 ml |

-continued

| Ingredient | Quantity |
|---|---|
| Cyclohexanone | 3.0 ml |

After drying for 2 minutes at 80° C the coated film was subbed on both sides with a gelatin sub layer, which was dried for 1 minute at 80° C, and the assembly heated for 3 minutes at 105° C and coated with a gelatino silver halide lith emulsion on one side and anti-halo backing on the other side as described in Example 3.

The photographic film assembly thus obtained had the same properties as the film produced in Example 3.

EXAMPLE 10

A uniaxially oriented polyethylene terephthalate film base was pretreated by coating on both sides with a copolymer prepared from 88 mole % vinylidene chloride and 12 mole % acrylonitrile. The coated film was then stretched transversely to the initial direction of stretch to produce an overall stretch of between 3 and 5 times in each direction and heat set. The applied coating had a dry weight of approximately 0.3 mg/dm² on each side.

The pretreated film was then coated on both sides with the following subbing solution:

| Ingredient | Quantity |
|---|---|
| Condensation polymer prepared from a 2/1/3 mole ratio of polyethylene adipate/1,4-butane diol/tolylene di-isocyanate (80/20% by weight mixture of 2,4- and 2,6-isomers) | 0.8 g |
| Copolymer prepared from a 50/50 mole ratio of vinyl acetate/maleic anhydride | 0.16 g |
| Hexamethoxy methyl melamine | 0.007 g |
| p-Toluene sulphonic acid | 0.007 g |
| Acetone | 97.0 ml |
| Cyclohexanone | 3.0 ml |

After drying for 2 minutes at 80° C the coated film was subbed on both sides with a gelatin sub layer which was dried for 1 minute at 80° C, and the assembly heated for 3 minutes at 105° C and coated with a gelatino silver halide lith emulsion on one side and an antihalo backing on the other side as described in Example 3.

The photographic film assembly thus obtained had the same properties as the film produced in Example 3.

EXAMPLE 11

The film support was pretreated with a solution of p-chloro-m-cresol as in Example 1 and was then coated on both sides with the following solutions:

| Ingredient | Quantity |
|---|---|
| Condensation polymer prepared from a 1/1/2 mole ratio of polyethylene adipate (molecular weight 1000)/ 1,4-butane diol/tolylene di-isocyanate (80/20% by weight mixture of 2,4- and 2,6-isomers) | 0.8 g |
| Copolymer of 50 mole % methylvinyl ether/50 mole % maleic anhydride (commercially available under the Trade Name "Viscofas" L100) | 0.16 g |
| Hexamethoxy methyl melamine | 0.03 g |
| p-Toluene sulphonic acid | 0.01 g |
| Acetone | 97.0 ml |
| Cyclohexanone | 3.0 ml |

After drying for 2 minutes at 80° C this coating had a final dry weight of between 1 and 2 mg/dm² on each side of the film. The coated surfaces of the film were then subbed with a gelatin subbing solution of the following composition:

| Ingredient | Quantity |
|---|---|
| Gelatin | 1.2 g |
| Water | 5.0 ml |
| Glacial acetic acid | 1.0 ml |
| Methanol | 94.0 ml |
| Formalin | 94.0 ml |
| Polyvinyl acetate (available commercially under the Trade Name "Mowilith" 70) | 0.125 g |

The gelatin coating was dried for 2 minutes at 80° C and then the assembly was heated for 3 minutes at 105° C. The gelatin coat had a dry coat weight of approximately 2 mg/dm$^2$ on each side of the film. A photographic gelatino silver halide lith emulsion and a conventional anti-halo backing were coated onto the gelatin subbing layer as described in Example 1. The photographic film assembly thus obtained had excellent adhesion before, during and after processing including developing in highly alkaline developers, showed good resistance to treatment with methylated spirit, was resistant to crazing after heating for 1 hour at 80° C and had good wet edge rub resistance. No adverse sensitometric affects on the photographic emulsion were observed.

EXAMPLE 12

Example 4 was repeated using an alternative subbing solution as follows:

| Ingredient | Quantity |
|---|---|
| Condensation polymer prepared from a 1/1/2 mole ratio of polyethylene adipate/1,4-butane diol/tolyene di-isocyanate (80/20% by weight mixture of 2,4- and 2,6-isomers) in ethyl acetate solution | 0.66 g |
| Homopolymer of maleic anhydride prepared by solution polymerisation in acetic anhydride | 0.13 g |
| Hexamethoxy methyl melamine | 0.007 g |
| p-Toluene sulphonic acid | 0.007 g |
| Acetone | 97.0 ml |
| Cyclohexanone | 3.0 ml |

The resulting photographic assembly had excellent emulsion adhesion before, during and after processing including development in highly alkaline developers, had good resistance to methylated spirit and was resistant to crazing after heating for 1 hour at 80° C. The coating had good wet edge rub resistance and there were no sensitometric or coating quality defects in the photographic emulsion.

EXAMPLE 13

Example 4 was repeated using an alternative subbing solution as follows:

| Ingredient | Quantity |
|---|---|
| Condensation polymer prepared from a 1/1/2 mole ratio of polyethylene adipate/1,4-butane diol/tolyene di-isocyanate (80/20% by weight mixture of 2,4- and 2,6-isomers) in ethyl acetate solution | 0.66 g |
| Homopolymer of itaconic anhydride prepared by bulk polymerisation | 0.13 g |
| Hexamethoxy methyl melamine | 0.007 g |
| p-Toluene sulphonic acid | 0.007 g |
| Acetone | 97.0 ml |
| Cyclohexanone | 3.0 ml |

The resulting photographic assembly had excellent emulsion adhesion before, during and after processing including development in highly alkaline developers, had good resistance to methylated spirit and was resistant to crazing after heating for 1 hour at 80° C. The coating had good wet edge rub resistance and there were no sensitometric or coating quality defects in the photographic emulsion.

The improvements obtainable using the present invention are illustrated in the table which compares conventional photographic assemblies prepared by the method described in British patent specification No. 1,088,906 with the photographic assemblies of the present invention as illustrated by Examples 1 and 2.

This table gives certain properties of the film assemblies.

| Description of photographic film assembly | Grade of normal wet and dry adhesion | Grade of alkaline developer adhesion | Grade of methylated spirit resistance | Grade of wet edge rub resistance | Grade of film flatness |
|---|---|---|---|---|---|
| A) Prepared according to Example 12 in BP 1 088 906, the gelatin subbing layer being heat treated at 105° C for 3 minutes, then being coated with a gelatino silver halide emulsion on one side and anti-halo backing on the other side and dried at 40° C for 20 minutes. | 1 | 4–5 | 3–3½ | 3–5 | 4 |
| B) Prepared as in A) above but the gelatin subbing layer being heat treated at 85° C instead of 105° C for 3 minutes. | 5 | 5 | 4 | 3–5 | 2 |
| C) Prepared according to Example 1 of the present invention, the gelatin sub being heat treated at 105° C for 3 minutes. | 1 | 1 | 1½–2 | 1 | 4 |
| D) Prepared according to Example 2 of the present invention, the gelatin | | | | | |

-continued

| Description of photographic film assembly | Grade of normal wet and dry adhesion | Grade of alkaline developer adhesion | Grade of methylated spirit resistance | Grade of wet edge rub resistance | Grade of film flatness |
|---|---|---|---|---|---|
| sub being heat treated at 85° C for 3 minutes. | 1 | 1 | 1½–2 | 1–2 | 2 |

The properties given in the above table are assessed as described below.

"Normal dry adhesion" refers to the adhesion of the gelatino silver halide photographic emulsion in the final photographic film assembly assessed, both before and after processing in standard photographic chemicals, by sticking adhesive tape along a torn edge of the film and then ripping the adhesive tape off. The adhesion of the emulsion is graded from 1 to 5, Grade 1 being when no emulsion is removed after 8 pulls of the tape and Grade 5 being when all the emulsion is removed with one pull. The final photographic film assembly is generally only acceptable if the normal dry adhesion is Grade 1.

"Normal wet adhesion" refers to the adhesion of the gelatino silver halide photographic emulsion in the final photographic film assembly, assessed, after processing in the standard photographic chemicals and washing in water for 15 minutes, by rubbing with a sponge over a series of lines scored in the still wet emulsion. The adhesion of the emulsion is graded from 1 to 5, Grade 1 being when no emulsion is removed from edges of the score line by 10 rubs with the sponge and Grade 5 being when all the emulsion is removed between the score lines by 10 rubs. The final photographic film assembly is generally only acceptable if the normal wet adhesion is Grade 1.

"Alkaline developer adhesion" refers to the wet adhesion of the gelatino silver halide stabilisation emulsion used in the final photographic film assembly, assessed, after processing in a highly alkaline activator at pH 12 followed by treatment in a stabiliser bath, by rubbing with a sponge over a series of lines scored in the still wet emulsion. The adhesion of the emulsion is graded from 1 to 5, Grade 1 being when no emulsion is removed by 10 rubs with the sponge and Grade 5 being when 10 rubs remove all the emulsion between the score lines. The final photographic film assembly is generally acceptable if the alkaline developer resistance is Grade 4–5 but when using stabilisation emulsions it is required to be Grade 1.

"Methylated spirit resistance" refers to the resistance of the fully processed final photographic film assembly to swabbing with methylated spirit, assessed by immersing the processed photographic film in water for 30 seconds followed by immersing in methylated spirit for 30 seconds and then scoring the emulsion with a screwdriver. The spirit resistance of the emulsion is graded from 1 to 5 Grade 1 being when the score line has clean edges with no tearing back of the emulsion along the edges and Grade 5 being when the edges of the score are not clean, showing severe pulling of the emulsion along the score line. The final photographic film assembly is generally acceptable if the spirit resistance is Grade 3–3½ but when used in Graphic Arts it is required to be Grade 1–2 in some cases.

"Wet edge rub resistance" refers to the ability of the final photographic film assembly to resist adhesion failure at the base — subbing layer interface when the wet processed film is rubbed vigorously with a finger or rubber stopper inwardly from the film edge 20 times. The wet edge rub resistance is graded from 1–5, Grade 1 being very good, i.e. no emulsion removed and Grade 5 being very poor, i.e. the emulsion being removed from 16 to 40 mm in from the film edge. For general purposes Grade 4 is regarded as being acceptable for Graphic Arts film use but for certain special applications Grade 1–2 is regarded as being necessary.

"Film flatness" refers to the edge and centre flutes from which the film base suffers when laid out on a flat surface after being coated on both sides with the subbing layers, including the gelatin subbing layer, and is assessed by laying an 8 foot long sample of the full width film on a flat surface and measuring the number and size of the flutes along each edge and along the centre of the film. The film flatness is graded from 1–5, Grade 1 being virtually free from flutes and very good, Grade 5 being badly fluted and very poor. For general purposes Grade 4 is normally regarded as being acceptable but for some Graphic Arts applications Grade 1–2 is required.

We claim:

1. A photographic film material, which comprises a biaxially oriented film support of a linear polyester having a subbing layer and a hydrophilic light sensitive layer applied to one or both surfaces thereof wherein the subbing layer is adherent to the film support, and comprises a mixture consisting essentially of at least one polyurethane resin with at least one anhydride polymer selected from the group consisting of:

(a) at least one homopolymer of a polymerisable unsatured cyclic carboxylic acid anhydride wherein said mixture contains from about 16.5% by weight of the anhydride polymer; and (b) at least one copolymer of a polymerisable unsaturated cyclic acid anhydride wherein said mixture contains from about 10% by weight of the anhydride polymer, the mixture containing up to 75% by weight of said anhydride polymer.

2. A photographic film material according to claim 1, in which the polyester film support is a polyethylene terephthalate film.

3. A photographic film material according to claim 1, in which the unsaturated cyclic carboxylic acid anhydride is selected from the group consisting of maleic anhydride, chloromaleic anhydride, any other substituted maleic anhydride, itaconic anhydride or citraconic anhydride.

4. A photographic film material according to claim 1, in which the polyurethane resin is chosen from a resin formed (a) by the condensation of one mole of polyethylene adipate with one mole of a 65/35% by weight mixture of 2,4-tolylene di-isocyanate with 2,6-tolylene di-isocyanate, (b) from the condensation of one mole of polytetramethylene adipate and one mole of 1,4-butane diol with two moles of diphenyl methane 4,4'-di-isocyanate, (c) by the reaction of one mole of a polyesteramide, prepared from adipic acid, diethylene glycol, ethylene glycol and ethanolamine, and 0.2 moles of ethylene glycol with 1.2 moles of an 80/20% by weight mixture of 2,4-tolylene di-isocyanate with 2,6-tolylene di-isocyanate or (d) by the condensation of one mole of polyethylene adipate of molecular weight 2000 and one mole of 1,4-butane diol with two moles of an 80/20% by weight mixture of 2,4-tolylene di-isocyanate and 2,6-tolylene di-isocyanate.

5. A photographic film material according to claim 1, in which a gelatin subbing layer is interposed between the polyurethane-anhydride polymer mixture subbing layer and the light sensitive layer.

6. A photographic film material according to claim 1, in which the subbing layer includes an anhydride copolymer formed with one or more comonomers selected from the group consisting of styrene, vinyl acetate, ethylene, methyl methacrylate and butadiene.

7. A photographic film material according to claim 3, in which the subbing layer includes an anhydride copolymer of maleic anhydride or itaconic anhydride with styrene, vinyl acetate or butadiene.

8. A photographic film material according to claim 1, in which the subbing layer includes an anhydride polymer formed with one or more comonomers chosen from methyl vinyl ether or a vinyl halogenoester.

9. A photographic film material according to claim 8 in which the copolymer is a terpolymer of 60/34/6 mole % vinyl monochloroacetate/methyl methacrylate/maleic anhydride and the unsaturated cyclic carbocylic acid anhydride is selected from the group consisting of maleic anhydride, chloromaleic anhydride, any other substituted maleic anhydride, itaconic anhydride or citraconic anhydride.

* * * * *